US006272884B1

(12) United States Patent
Billingham et al.

(10) Patent No.: US 6,272,884 B1
(45) Date of Patent: Aug. 14, 2001

(54) RAPID RESTART SYSTEM FOR CRYOGENIC AIR SEPARATION PLANT

(75) Inventors: John Fredric Billingham, Getzville; Dante Patrick Bonaquist, Grand Island; James Robert Dray, Kenmore; Michael James Lockett, Grand Island; Robert Arthur Beddome, Tonawanda, all of NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/056,709

(22) Filed: Apr. 8, 1998

(51) Int. Cl.[7] ..... F25J 1/00
(52) U.S. Cl. ..... 62/656; 356/501
(58) Field of Search ..... 62/656; 364/501

(56) References Cited

U.S. PATENT DOCUMENTS 5,257,206 10/1993 Hanson ..... 364/502
5,329,443 7/1994 Bonaquist et al. ..... 364/153
5,431,023 * 7/1995 Howard et al. ..... 62/656
5,505,051 * 4/1996 Darredeau et al. ..... 62/656

FOREIGN PATENT DOCUMENTS 681153 11/1995 (EP) .

* cited by examiner

*Primary Examiner*—Ronald Capossela
(74) *Attorney, Agent, or Firm*—Stanley Ktorides

(57) ABSTRACT

A system for re-starting an air separation plant after an interruption in operation wherein descending liquid is collected in a non-operating distillation column and passed back to the separation section of that column before or upon re-start. The invention may employ a collection device situated in the column above the sump. Upon interruption in operation, the collection device accumulates descending liquid. From the collection device, liquid may be passed outside of the column and transferred to a holding vessel to re-inventory internal material of the column upon resumption in operation.

10 Claims, 5 Drawing Sheets

RAPID RESTART SYSTEM FOR CRYOGENIC AIR SEPARATION PLANT

TECHNICAL FIELD

This invention relates generally to the operation of cryogenic air separation plants and more particularly, to efficiently restarting distillation columns in such plants after an interruption in operation.

BACKGROUND ART

A considerable amount of time is usually required to restart a cryogenic air separation plant following a shutdown or interruption in operation. The shutdown or interruption may be caused by a number of reasons such as power interruption, equipment problem, oversupply of non-condensable gas to a column, or an economic choice brought about by high power rates. The non-productive period from restart until product purities are re-established is costly, consuming the same amount of power as during normal production, but not providing desired product. In addition, product may have to be delivered by other means during downtime at considerable cost and burden on a product delivery system. At many plants the number of unscheduled shutdowns or interruptions in operation makes this non-productive period a significant factor.

A vertical composition profile exists throughout a distillation column. The liquid held up at various levels in the column becomes progressively richer in the more volatile component in ascending order in the column. Examples of composition profiles typical of air separation plants may be found in published literature (e.g. R. Latimer, "Distillation of Air", Chemical Engineering Progress, Volume 63, Number 2, pp. 35–59, 1967). A distillation column in an air separation plant promotes separation of the components of air when the air, in liquid and vapor form, contacts internal material situated in the distillation column. The internal material may be any of the known materials used to promote separation in distillation columns such as trays or packing. Rising vapor in the column serves to hold up liquid on internal material in the column. When vapor flow ceases in a distillation column the majority of liquid, which was held up on the internal material by the vapor, will drain from the internals to the bottom of the column or column sump. The resulting liquid pool is of a composition intermediate between the column's top and bottom compositions during normal operation.

To restart the operation of the air separation column(s), liquid retained at the bottom or sump of the column(s) is normally drained or is reprocessed to reestablish desired purity. By draining liquid from the sump, refrigeration provided by that liquid to the plant is lost, representing a power penalty. By reprocessing liquid from the sump, upon restart, significant time is required to re-establish purity of liquid, resulting in costly power consumption.

By draining liquid from the sump in argon producing plants, a considerable quantity of argon is lost. Because argon is such a minor component in air, a costly time delay occurs before argon purity is reestablished when the plant or argon column is restarted.

After an interruption in operation, it would be desirable and advantageous to efficiently re-start a plant by reducing the time required to achieve desired purity on an air separation plant or a distillation column in a plant, in a cost effective and simple manner.

Accordingly, it is an object of this invention to provide a system for restarting a cryogenic air separation plant in a faster and less costly manner than is possible with conventional practice.

SUMMARY OF THE INVENTION

The above and other objects, which will become apparent to those skilled in the art upon a reading of this disclosure, are attained by the present invention, one aspect of which is:

A method for efficiently re-starting a distillation column of a cryogenic air separation plant after an interruption in operation, said column having a separation section and containing liquid, comprising the steps of:

(A) collecting liquid from the separation section of the distillation column;

(B) passing the liquid collected in step (A) back to the separation section of the distillation column; and (C) re-starting the distillation column.

Another aspect of the invention is:

An apparatus for efficiently re-starting an air separation plant after an interruption in operation, comprising:

(A) at least one distillation column having a separation section with internal material;

(B) means for collecting liquid in the distillation column, said means communicating with a holding vessel for storing collected liquid; and (C) means for passing collected liquid from the holding vessel to the separation section of the distillation column before re-starting the distillation column.

A preferred embodiment of the invention uses a collection device for collecting descending liquid in a column when column operation is interrupted.

In another preferred embodiment of the invention, the collected liquid is stored in a holding vessel and made available to re-inventory the separation section of the column from which liquid was collected.

Figure 1:
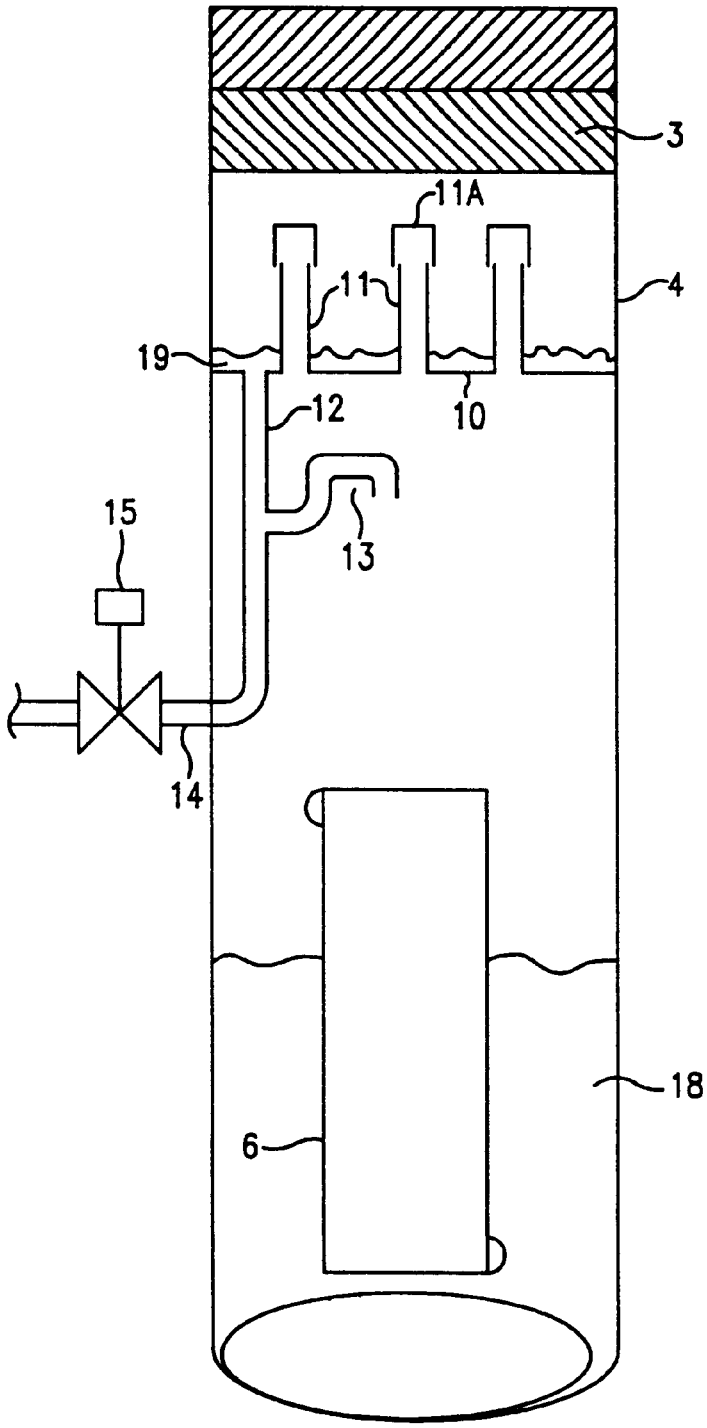
FIG. 1 is a schematic diagram of a preferred embodiment of the invention wherein, upon interruption of operation of a two column air separation plant, descending liquid in the low pressure column is collected on a sealed tray and removed from that column.

The numerals in the Drawings are the same for the common elements.

DETAILED DESCRIPTION OF THE INVENTION

The invention accomplishes an efficient re-start of an air separation column or columns in a cryogenic air separation plant. The efficient re-start is accomplished by collecting descending liquid in a distillation column when operation is interrupted or stopped in that column, and then using the collected liquid to re-inventory the distillation column separation section before or upon re-start. Descending liquid refers to liquid that drains or descends from the internal material and inner walls in a distillation column of the plant.

In a distillation column where there is a main condenser, collecting descending liquid in the column prevents mixing of that liquid with accumulated liquid in the bottom of the column, thus preventing loss in purity of the bottom liquid. Before column operation is re-started, or upon re-starting the gas supply to the column, the collected liquid is provided to the separation section of the column, i.e. that section of the column having internal material. In this separation section, collected liquid is used to re-inventory the internal material therein with liquid. Maintenance of the purity of the main condenser and re-inventory of liquid to the separation section each promote a more efficient re-start of the column in a timely manner.

When operation of an argon column is interrupted or stopped, collection of descending liquid in the argon column also facilitates a more efficient re-start. Collected liquid is used to re-inventory the separation section of the argon column with liquid before restarting that column or upon re-start of gas supply to the column, In FIG. 1, a collection device, situated in a distillation column, is used to divert the flow of descending liquid from a main condenser pool and maintain purity therein. The collection device or collector comprises, for example, a sealed tray 10 with risers 11 covered by hats 11A. The collector 10 allows vapor and liquid to flow countercurrently without impeding one another. Liquid collects on the sealed tray 10 and drains through one or more passages or downcomers 12 that extend below the tray. These downcomers 12 contain a branch. One leg 13 of this branch is open to the upper column 4. The other leg or diversion circuit 14, is piped to outside of the column. Diversion circuit 14 contains a valve 15. During normal operation of the plant, valve 15 is closed and descending liquid collects on sealed tray 10, flows down the downcomer 12 and overflows through leg 13 to the pool of liquid oxygen 18 below at the main condenser 6. Upon shutdown or interruption in operation, valve 15 is opened and the liquid 19 accumulating on sealed tray 10 flows through downcomer 12 and is diverted through valve 15 and sent to drain. Typically the liquid would be vaporized and sent to atmosphere. Upon resumption of air feed to the plant, valve 15 is closed and operation of the plant continues with the pool of oxygen 18, at the main condenser 6, at essentially the same purity as before operation was interrupted.

Piping 12, 13 and 14 are schematically shown in FIG. 1 and could be modified according to accepted design practices for cryogenic liquid service. For example, thermal expansion joints could be included and the diversion circuit 14 could be located outside the column 4. The system illustrated FIG. 1 requires little capital investment. Because purity of bottom liquid is maintained, this method also decreases the required time for an air separation plant to produce desirable product following a shutdown or interruption in operation. The invention is applicable to any air separation cycle. The embodiment of the invention shown in FIG. 1 is especially useful for an air separation process producing high purity oxygen product.

Figure 2:
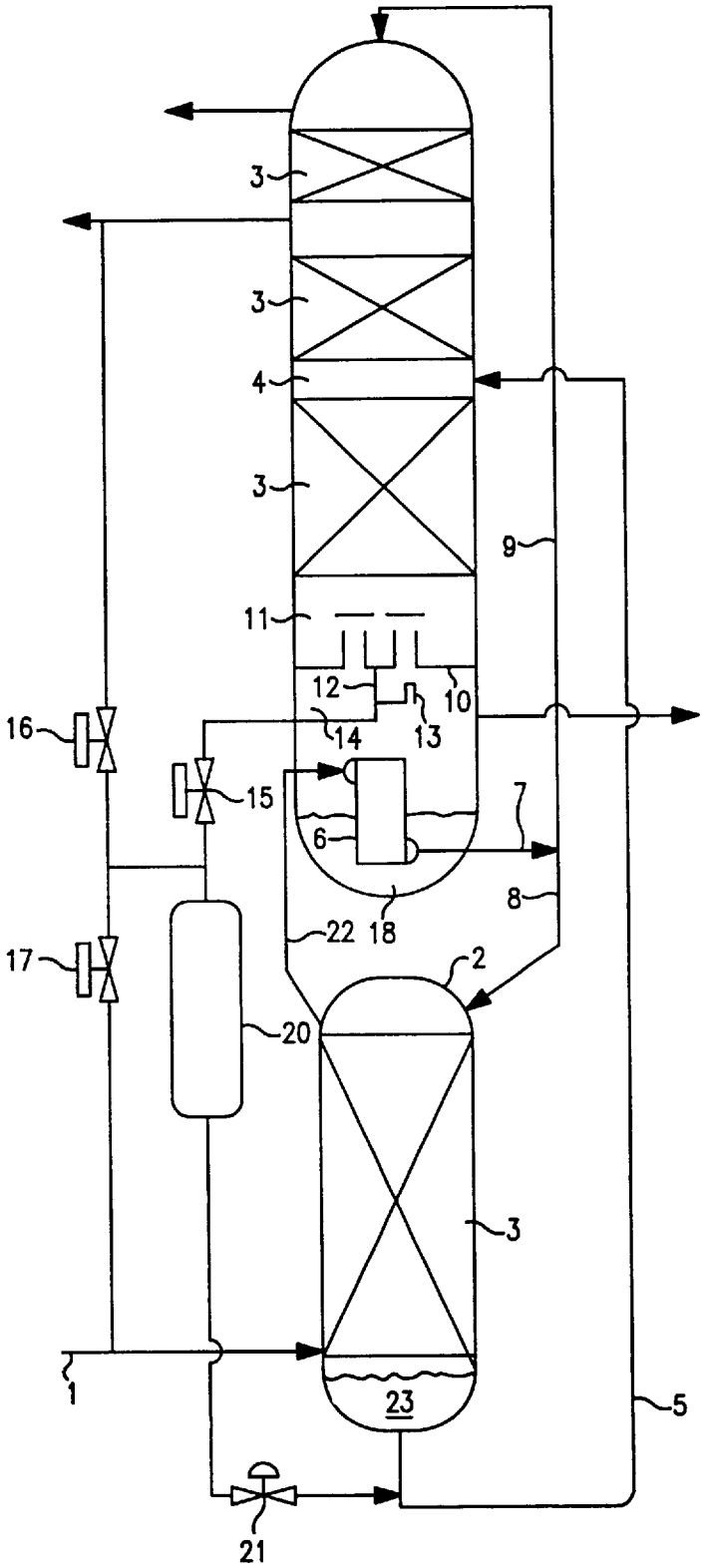
FIG. 2 is a schematic diagram of a preferred embodiment of the invention wherein, upon interruption of operation of a two column air separation plant, descending liquid in the low pressure column is collected, stored and made available for return to the column when the plant is re-started.

The system shown in FIG. 1 is effectively a portion of that shown in FIG. 2, which shows a cryogenic air separation plant having two columns. In the embodiment of the invention shown in FIG. 2, descending liquid in an air separation distillation column is collected and stored in a holding vessel when operation of the column is interrupted. The liquid in the holding vessel is made available to re-inventory the separation section of the same column from which liquid was collected.

In FIG. 2, clean cold air under moderate pressure in piping 1 is fed to high pressure or lower distillation column 2. Lower column 2 can employ internal material 3 of any type suitable in its separation section, e.g. trays, or packing normally used in the industry to carry out the separation process. In lower column 2 the air stream is separated to produce a nitrogen rich stream at the top and a liquid in equilibrium with the feed air, called kettle liquid 23, at the bottom. Kettle liquid 23 at the bottom of lower column 2 is transferred to an intermediate level in low pressure or upper distillation column 4 by piping 5. Upper column 4 is also fitted with internal material 3 in its separation section, which is not necessarily the same as the internal material of lower column 2. Nitrogen 22 taken off at the top of lower column 2 is piped to main condenser 6 where it is totally condensed against vaporizing liquid oxygen 18 at the bottom of upper column 4. The resulting liquid nitrogen 7 is divided into two streams, 8 and 9. Stream 8 returns a portion of the liquid nitrogen to lower column 2 as reflux. The remainder, stream 9, transfers liquid nitrogen as reflux to the top of upper column 4.

During normal operation a composition profile exists in upper column 4 whereby nitrogen content of both liquid and vapor increases from the bottom to the top of the column. When the flow of feed air 1 to lower column 2 is interrupted, the pressure in lower column 2 quickly drops until there is little or no condensing/boiling at main condenser 6. Cessation of activity at the main condenser causes a cessation of all liquid feeds to upper column 4 and stops the flow of stripping vapor from the oxygen liquid pool 18 in the sump of upper column 4. The liquid retained on the upper column internal materials 3 drains as descending liquid, under gravity, within upper column 4. When the internal material is sieve trays for example, the liquid will rain through the perforations in the trays. When the internal material is packing, the film on the packing and the liquid held up in the distributors sitting on top of the packing will drain downward.

A collection device, e.g., a sealed tray 10, collects descending liquid within upper column 4 at a level above main condenser 6. This sealed tray 10 prevents descending liquid, such as from internal material 3, from reaching main condenser 6 and contaminating the oxygen liquid pool 18. The oxygen concentration or purity of the oxygen liquid pool 18 is typically within the range of from 95–99.9 mole percent.

When the flow of feed air 1 to lower column 2 is stopped, valves 15 and 16 are opened. Opening these valves causes liquid flow from collector 10 to be diverted from leg 13 and to flow through diversion circuit 14 to holding vessel 20. Holding vessel 20 may be located either inside or outside the cold box that encloses the distillation column 4.

Liquid oxygen 18 in the sump of upper column 4 therefore maintains purity Holding vessel 20 is sized such that it can hold the contents of the liquid from upper column 4 and, in cases where a conventional three column arrangement is used, the contents of the argon column also. The volume of holding vessel 20 is typically 5–20 percent of the volume of the upper and argon columns. The size of holding vessel 20 depends on whether the internals are trays or packing. Valve 16 is opened while vessel 20 is filled, to allow pressure equalization between upper column 4 and holding vessel 20.

Upon resumption of air feed 1 to lower column 2, liquid inside holding vessel 20 may be used to re-inventory internal material 3 in the separation section of upper column 4. Re-inventory of liquid to the upper column can be accomplished by pressure transfer. Valves 15 and 16 are closed and valve 17 opened. By so doing, the pressure in holding vessel 20 is raised to that of lower column 2. The stored liquid is then transferred to upper column 4. This transfer of liquid can be accomplished by metering the liquid into the sump of lower column 2. Liquid in holding vessel 20 then flows through valve 21 into kettle liquid transfer line 5.

The liquid transfer rate is controlled such that the oxygen purity in main condenser 6 is maintained.

Once holding vessel 20 is cleared of its liquid inventory, valves 17 and 21 are closed and valve 16 is opened. The pressure in holding vessel 20 is reduced to the pressure of upper column 4. The system is then in a stand-by state for the next interruption in operation of the distillation column.

Alternatively, the lower column sump 23 can be used as a holding vessel for liquid from the upper column. This option is not shown in FIG. 2. However, to use this option, the sump size must be larger than in conventional practice. If the lower column sump 23 is used as a holding vessel, vessel 20 and the conduits with valves 16 and 17 could be eliminated. Instead, conduit 14 would extend directly to the sump at the bottom of the high pressure column 2 and include only valve 15. During normal operation valve 15 would be closed whereas during plant or distillation column interruption, valve 15 would be opened thereby allowing upper column liquid to drain directly to the lower column sump. In addition, means must be provided to reduce pressure in the lower column to a point that will allow liquid from the upper column to flow into it. The necessary pressure reduction is achieved by the hydrostatic head of liquid available. Liquid is contained and then transferred back to appropriate locations within the upper column on resumption of feed air supply. By reinventory of liquid to the upper column, purity of liquid in the main condenser is maintained and refrigeration is not lost to the plant. By the present invention, significant time and cost are reduced for re-starting and achieving desired purity in an air separation plant following each interruption in operation.

The return line from holding vessel 20 can enter at any location in the separation section of upper column 4 of FIG. 2. It can also be used to inventory the low ratio or argon column condenser 27. Optionally, although not preferred, it could even provide liquid to the argon column 30 itself in three column plants.

Figure 3:
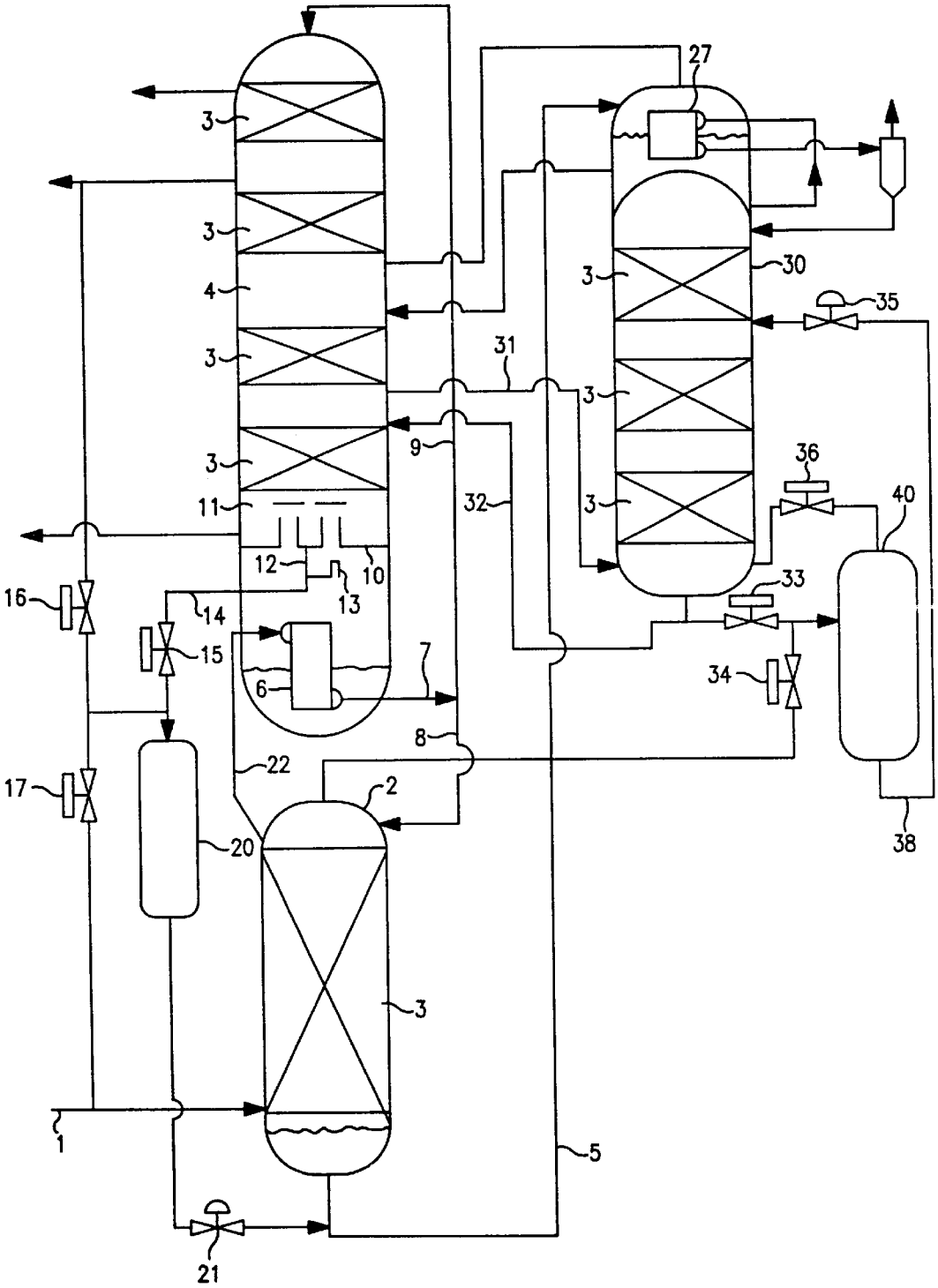
FIG. 3 is a schematic diagram of another preferred embodiment of the invention wherein, upon interruption of operation in a three column air separation plant, descending liquid in the low pressure column and descending liquid in the argon column is collected, stored and made available for return to the respective columns upon restart of the columns.

In FIG. 3, a three column arrangement is shown with upper and lower distillation columns as in FIG. 2 and a third distillation column where argon is produced. In this embodiment of the invention, liquid in an argon column of an air separation plant is collected upon interruption of the operation of the column. The collected liquid may be stored in a holding vessel. Either before re-start or upon re-start of operation of the argon column, liquid collected from that column is used to re-inventory the separation section of the argon column which contains internal material 3. For argon columns, it is desirable for any liquid in the column sump to be collected along with the liquid from the column separation section.

During normal operation, a crude argon column vapor feed 31 from upper column 4 is passed to argon column 30 and a liquid stream 32 is returned to the upper column 4 at the same location. Liquid inside argon column 30 has a much higher argon concentration than liquid in upper column 4. It is therefore advantageous to keep argon column 30 liquid separated from upper column 4 liquid during shut down or interruption in operation of the argon column.

When column operation is interrupted, argon column liquid can be prevented from mixing with upper column liquid by applying an analogous piping scheme as in the embodiment illustrated in FIG. 2 to the base of argon column 30. An external holding vessel 40 can be used for liquid argon storage. Alternatively, a vessel sharing the same shell as argon column 30 can be used, but with a separating head. Collected argon column liquid is pumped or pressure transferred via piping 38 back to the top of argon column 30 or to some intermediate location within the separation section of that column.

An arrangement of piping and valves allow for pressure transfer of liquid between holding vessel 40 and argon column 30. During normal operation valves 33 and 34 are closed. Valve 36 is open such that the pressure in holding vessel 40 is the same as the pressure at the base of argon column 30. Upon interruption of operation, valve 33 is opened and argon rich liquid in argon column 30 is transferred to holding vessel 40 rather than upper column 4.

On re-start, valves 33 and 36 are closed. Valve 34 is opened. The pressure in holding vessel 40 is raised to that of lower column 2. Liquid contained in holding vessel 40 is passed back, through control valve 35, to re-inventory a separation section of argon column 30. Optimally, the collected liquid is provided to an intermediate position within argon column 30. Alternatively, descending liquid may be collected and stored at the bottom or sump of argon column 30. This option requires means, such as a pump, for transferring collected liquid back to separation section column 30 upon re-start.

For high purity argon, superstaged argon distillation columns can be used to produce an argon product with low oxygen concentration, less than 10 ppm oxygen. A superstaged argon column contains a greater number of stages than a low ratio argon column. It includes both the number of stages required for the low ratio argon column plus additional stages required for high purity or product grade argon.

Superstaged columns require a considerable amount of time to achieve product purity following an interruption in operation. This is because superstaged columns have very large numbers of stages, and the liquid held up in the superstaged column is argon which is a minor component of air. Interruption of operation of argon or superstaged argon columns can occur either due to condenser binding or a loss of feed air to the air separation plant. Condenser binding refers to an accumulation of non-condensable vapors, e.g. excessive nitrogen, that will prevent condensation of vapor at the top of the argon column against the refrigerating liquid at the top of the argon column.

The superstaged column is perhaps the most important of all columns to maintain liquid inventory since it contains a large volume of argon. In normal operation, it takes a period of several hours following start-up to inventory the internal material of the superstaged argon column with a steady state amount of liquid with the correct composition.

An arrangement similar to that for the upper and lower columns illustrated in FIG. 2 can be used to re-start a superstaged column. However, the arrangement is simplified since a liquid pump is already present for normal operation that can return collected liquid to the top of the superstaged column prior to re-starting the condenser. Thus, the piping and valves necessary for pressure transfer of the liquid is not needed.

Figure 4:
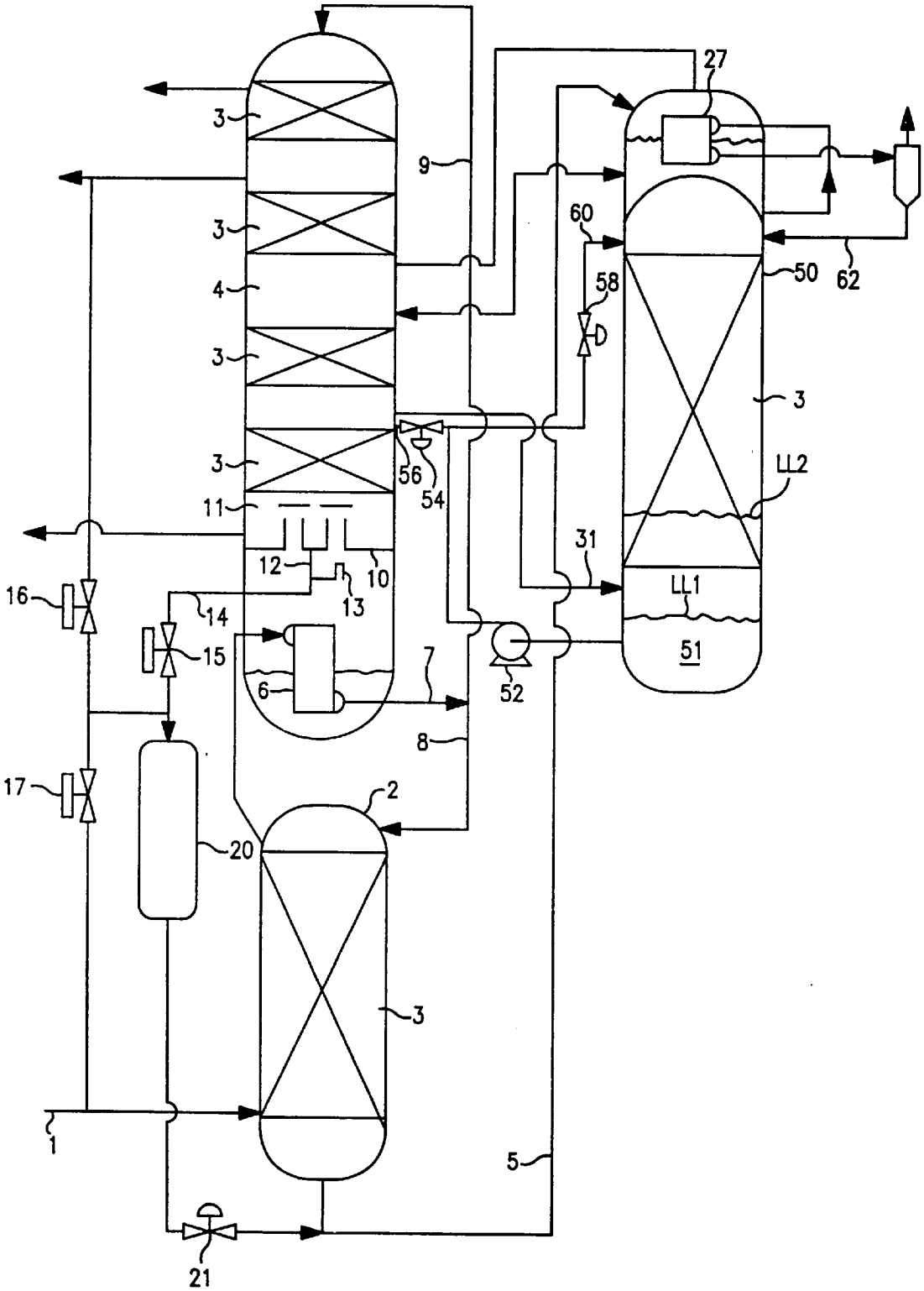
FIG. 4 is a schematic diagram of another preferred embodiment of the invention wherein, upon interruption of operation in a three column air separation plant, descending liquid in the upper column and in the argon column is removed, stored and made available for return to the respective columns upon restart and wherein the liquid return to the argon column may require a liquid transfer pump.

In FIG. 4, the three column arrangement includes a superstaged argon column 50. During normal operation, vapor 31 from the upper column 4 is provided to argon column 50. Valve 58 is closed and liquid 51 is returned to upper column 4, via pump 52, through open valve 54 and piping 56. Upon interruption of operation of the superstaged column 50, descending liquid is collected at the bottom of that column. The liquid level rises in column 50 from LL1 up to LL2.

Upon re-start of the superstaged column, valve 58 is opened. Liquid 51 is transferred from the bottom of column 50 via pump 52 through valve 58 to a dedicated line 60 to column 50 to re-inventory the separation section therein. Usually, liquid re-inventory is started before re-starting gas supply to the column. Providing liquid to the top or an intermediate section of column 50 builds liquid on the internal material 3 in the separation section.

The composition of collected liquid 51 is equal to the average composition of liquid held-up in column 50 during normal operation. Upon re-starting the condenser 27, vapor 31 is drawn from upper column 4 into the superstaged column 50 and liquid reflux 62 flows from the condenser and supplements the liquid 60 being pumped to the top of column 50. As vapor 31 is drawn, the recirculative liquid 60 valve 58 is slowly closed and the liquid 56 upper column valve 54 is slowly opened. The recirculation loop valve 58 is eventually fully closed and normal operation is resumed with return liquid 56 to the upper column controlling the sump liquid level.

Figure 5:
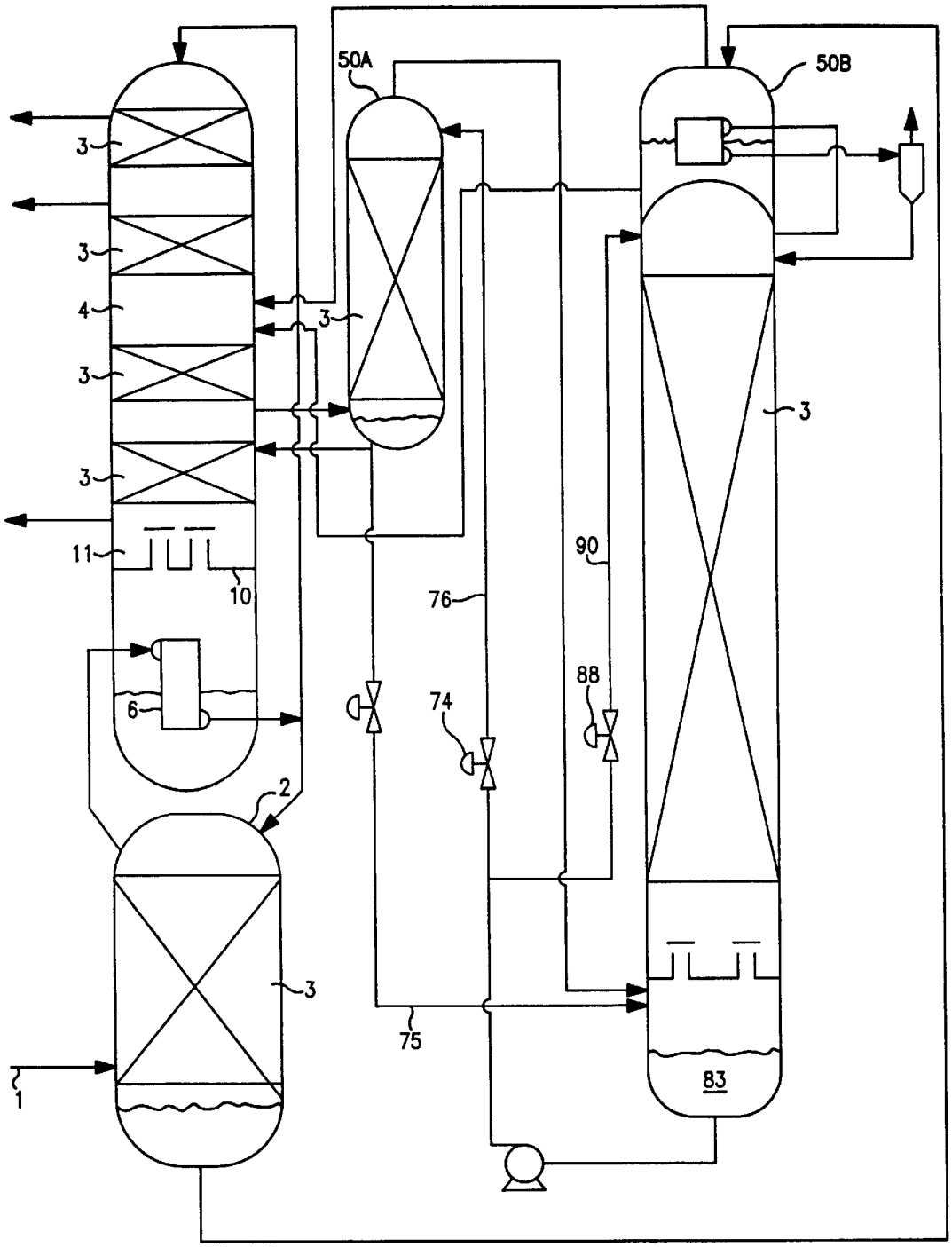
FIG. 5 is a schematic diagram of another preferred embodiment of the invention. The air separation system of this embodiment is similar to that of FIG. 4 except that the argon column is divided into two separate sections.

In the embodiment illustrated in FIG. 5, the cryogenic air separation plant has a two section argon column that includes a low ratio argon column 50A and an additional column 50B with sufficient stages so that the combination is equivalent to the superstaged argon column 50 illustrated in FIG. 4. The split column of FIG. 5 is sometimes desired to meet column height restrictions.

Upon interruption in operation, descending liquid in column 50A can be sent via piping 75 to the bottom of the additional column 50B. Efficient re-start of the column(s) is again achieved by recirculating liquid 83 from the bottom of additional column 50B back to the top of the additional column 50B via valve 88 and piping 90, and to the top of column 50A, via valve 74 and piping 76, before or upon drawing vapor into the columns 50A and 50B.

The invention can be utilized with any process arrangement. For example, when a separate holding vessel is used to collect descending column liquid, the holding vessel can be pressurized using a common line between the lower column or the pre-purified air feed from the warm end of the plant. The vent line can be sent to the waste or vented to the atmosphere.

In a two column system such as is illustrated in FIG. 2, diversion of descending liquid in the distillation column need not be immediate on loss of feed air to that distillation column. The liquid held up on the distillation column internal material directly above the sump will also be essentially pure oxygen. Since the volume of the sump is significantly greater than the amount of liquid held up in a few trays or short heights of packing, it is possible to allow some column liquid to mix with liquid in the sump without significantly compromising product purity. Some delay may be tolerated, but the duration of such delay will depend on the hold up of liquid on the internal material and the type of cycle. Alternatively it would be possible to put the sealed tray at a location above a few trays or short heights of packing above the sump. This would allow the oxygen rich liquid below the tray to drain into the sump but keep other liquid from draining into the sump.

The invention can be used in conjunction with various process control arrangements Specific features of the invention are shown in one or more of the drawings for convenience only, as each feature may be combined with other features in accordance with the invention. Alternative embodiments will be recognized by those skilled in the art and are intended to be included within the scope of the claims.

We claim:

1. A method for efficiently re-starting a distillation column of a cryogenic air separation plant after an interruption in operation, said column having a separation section and containing liquid, comprising the steps of:

(A) collecting liquid from the separation section of the distillation column;

(B) passing the liquid collected in step (A) back to the separation section of the distillation column; and (C) re-starting the distillation column.

2. The method of claim 1, wherein the liquid collected in step (A) is passed to a holding vessel for storage and then passed back to the separation section of the distillation column.

3. The method of claim 1, wherein the liquid is collected in step (A) using a collection device.

4. The method of claim 3, wherein the collection device is a sealed tray.

5. The method of claim 3, wherein the liquid collected on the collection device is vented.

6. An apparatus for efficiently re-starting an air separation plant after an interruption in operation, comprising:

(A) at least one distillation column having a separation section with internal material;

(B) means for collecting liquid in the distillation column, said means communicating with a holding vessel for storing collected liquid; and (C) means for passing collected liquid from the holding vessel to the separation section of the distillation column before restarting the distillation column.

7. The apparatus of claim 6, wherein the at least one distillation column has a collection device having means for allowing vapor to pass through it, for collecting liquid and for controlling distribution of liquid.

8. The apparatus of claim 7, wherein the at least one distillation column has a bottom main condenser and the collection device is situated between the bottom main condenser and the separation section of the distillation column.

9. The apparatus of claim 6, wherein the at least one distillation column is an argon column.

10. The apparatus of claim 6, wherein the at least one distillation column is a super staged argon column.

* * * * *